US010436486B2

(12) United States Patent
Maeda et al.

(10) Patent No.: US 10,436,486 B2
(45) Date of Patent: Oct. 8, 2019

(54) AIR-CONDITIONING APPARATUS AND METHOD OF INSTALLING THE SAME

(71) Applicant: Mitsubishi Electric Corporation, Tokyo (JP)

(72) Inventors: Akira Maeda, Tokyo (JP); Takao Komai, Tokyo (JP); Yasuhiro Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 267 days.

(21) Appl. No.: 15/129,864

(22) PCT Filed: Mar. 30, 2015

(86) PCT No.: PCT/JP2015/059952

§ 371 (c)(1),
(2) Date: Sep. 28, 2016

(87) PCT Pub. No.: WO2015/152163

PCT Pub. Date: Oct. 8, 2015

(65) Prior Publication Data

US 2017/0146274 A1 May 25, 2017

(30) Foreign Application Priority Data

Apr. 2, 2014 (WO) ..... PCT/JP2014/059707

(51) Int. Cl.
*F25B 45/00* (2006.01)
*F24F 1/005* (2019.01)
(Continued)

(52) U.S. Cl.
CPC ..... *F25B 45/00* (2013.01); *F24F 1/005* (2019.02); *F24F 1/0007* (2013.01);
(Continued)

(58) Field of Classification Search
CPC .... F25B 45/00; F25B 49/02; F25B 2345/007; F25B 2500/19; F25B 2345/001
See application file for complete search history.

(56) References Cited

U.S. PATENT DOCUMENTS

2001/0037649 A1 11/2001 Fujitaka et al.
2013/0180268 A1 7/2013 Schlosser
2014/0033754 A1 2/2014 Hatomura et al.

FOREIGN PATENT DOCUMENTS

CN 1247598 A 3/2000
JP 2000-234797 A 8/2000
(Continued)

OTHER PUBLICATIONS

Extended EP Search Report dated Jan. 22, 2018 issued in corresponding EP patent application No. 15774460.8.
(Continued)

*Primary Examiner* — Frantz F Jules
*Assistant Examiner* — Lionel Nouketcha
(74) *Attorney, Agent, or Firm* — Posz Law Group, PLC

(57) ABSTRACT

An indoor unit of an air-conditioning apparatus is installed at an installation height of $h_0$ or more in an installation floor space A [$m^2$] and a refrigerant amount M [kg] to be filled falls within (formula) $M \leq \alpha \times G^{-\beta} \times h_0 \times A$.

8 Claims, 6 Drawing Sheets

(51) Int. Cl.

| | |
|---|---|
| ***F24F 1/0047*** | (2019.01) |
| ***F24F 1/0057*** | (2019.01) |
| ***F24F 13/32*** | (2006.01) |
| ***F25B 49/02*** | (2006.01) |
| ***F24F 1/0007*** | (2019.01) |

(52) U.S. Cl.

CPC ..... *F24F 1/0047* (2019.02); *F24F 1/0057* (2019.02); *F24F 13/32* (2013.01); *F25B 49/02* (2013.01); *F25B 2345/001* (2013.01); *F25B 2400/12* (2013.01); *F25B 2500/19* (2013.01)

(56) References Cited

FOREIGN PATENT DOCUMENTS

| | | | |
|---|---|---|---|
| JP | 3477184 | B2 * | 12/2003 |
| JP | 2004-116885 | A | 4/2004 |
| JP | 2013-032912 | A | 2/2013 |
| WO | 2012/160598 | A1 | 11/2012 |

OTHER PUBLICATIONS

Office Action dated May 3, 2017 issued in corresponding AU patent application No. 2015239199.

International Search Report of the International Searching Authority dated Jun. 23, 2015 for the corresponding international application No. PCT/JP2015/059952 (and English translation).

Office Action dated Apr. 5, 2016 issued in corresponding JP patent application No. 2015-553340 (and English translation).

Office Action dated Aug. 8, 2017 in the corresponding JP patent application No. 2016-198259 (with English translation).

Office action dated Aug. 28, 2018 issued in corresponding CN patent application No. 201580018173.9 (and English translation thereof).

* cited by examiner

AIR-CONDITIONING APPARATUS AND METHOD OF INSTALLING THE SAME

CROSS REFERENCE TO RELATED APPLICATIONS

This application is a U.S. national stage application of PCT/JP2015/059952 filed on Mar. 30, 2015, which claims priority to International Patent Application No. PCT/JP2014/059707 filed on Apr. 2, 2014, the contents of which are incorporated herein by reference.

TECHNICAL FIELD

The present invention relates to an air-conditioning apparatus using flammable refrigerant and a method of installing the same.

BACKGROUND

Until now, there has been an air-conditioning apparatus executing a refrigeration cycle by using "hydrofluorocarbon (HFC) refrigerant" such as nonflammable R410A. The R410A is different from "hydrochlorofluorocarbon (HCFC) refrigerant" such as a conventional R22, zero in ozone depleting potential (ODP), never destroy the ozone layer, but high in global warming potential (hereinafter referred to as GWP). Therefore, a change of the HFC refrigerant such as the R410A high in GWP to refrigerant low in GWP (hereinafter referred to as low GWP refrigerant) has been made as one of global warming preventions.

There has been hydrocarbon (HC) refrigerant such as R290 ($C_3H_8$; propane) or R1270 ($C_3H_6$; propylene) being natural refrigerant as candidates for the low GWP refrigerant. Unlike the nonflammable R410A, the HC refrigerant is high in flammability, so that care and precaution must be taken not to leak refrigerant.

As candidates for the low GWP refrigerant, there has been the HFC refrigerant having no double bond of carbons in composition such as, for example, R32 ($CH_2H_2$; difluoromethane) being lower in GWP than the R410A.

Furthermore, as a similar candidate for refrigerant, there has been halogenated hydrocarbon being one type of the HFC refrigerant similar to the R32 and having double bond of carbons in composition. As such halogenated hydrocarbon, there has been known, for example, HFO-1234yf ($CF_3CF{=}CH_2$; tetrafluoropropene) or HFO-1234ze ($CF_3{-}CH{=}CHF$). The HFC refrigerant having double bond of carbons in composition is often represented as "HFO refrigerant" using "O" of olefin (because unsaturated hydrocarbon having double bond of carbons is called olefin) to discriminate from the HFC refrigerant having no double bond of carbons in composition, such as the R32.

The low GWP refrigerant such as the HFC refrigerant and the HFO refrigerant is not flammable than the HC refrigerant such as the R290 ($C_3H_8$; propane) being natural refrigerant, but slightly flammable unlike the nonflammable R410A. For this reason, care must be taken not to leak refrigerant, as is the case with the R290. Hereinafter, even the refrigerant that is slightly flammable is referred to as "flammable refrigerant."

Patent Literature 1, for example, discusses a method of decreasing the risk of ignition caused in a case where the flammable refrigerant leaks by any chance, such that a refrigerant amount calculated from an installation floor space manually input according to a relational expression uniquely determined with reference to the following formula I related to an allowable refrigerant amount per room $m_{max}$ [kg] being not ventilated and defined by International Electrotechnical Commission IEC60335-2-40 is compared with a refrigerant amount in an air-conditioning apparatus and the refrigerant exceeding the allowable refrigerant amount $m_{max}$ is discharged and transferred to a surplus refrigerant storage unit.

$$m_{max}=2.5\times(\mathrm{LFL})^{1.25}\times h_0\times(A)^{0.5} \quad \text{(Formula I)}$$

$m_{max}$: Allowable refrigerant amount per room [kg]
A: Installation floor space [$m^2$]
LFL: Lower flammability limit of refrigerant [$kg/m^3$]
$h_0$: Installation height of unit (indoor unit) [m]

Here, the installation height $h_0$ is 0.6 m in a floor type, 1.8 m in wall type, 1.0 m in window type, and 2.2 m in ceiling type.

PATENT LITERATURE

Patent Literature 1: Japanese Patent No. 3477184

However, in the technique using the formula I discussed in Patent Literature 1, a term related to a leak speed of the refrigerant is not included in the formula I, so that there is a concern that the refrigerant amount may be excessively restricted (discharged). In an air-conditioning apparatus for business use whose refrigerant pipe for connecting an outdoor unit to an indoor unit is long and which may be more often installed to a high heat load property such as a commercial kitchen than a home-use air-conditioning apparatus, even if a technique for decreasing the refrigerant to be enclosed is fully made use of, it is difficult to satisfy the formula I while the required capacity is exhibited.

SUMMARY

The present invention has been made to solve the above problems and has an objective to provide an air-conditioning apparatus filling an effective refrigerant amount and securing safety in the air-conditioning apparatus using the flammable refrigerant being higher in density than air under the atmospheric pressure.

The air-conditioning apparatus according to one embodiment of the present invention includes an indoor unit on which an indoor heat exchanger is mounted and uses the flammable refrigerant being higher in density than air under the atmospheric pressure. The indoor unit is installed at an installation height of $h_0$ [m] or more, (which complies with IEC60335-2-40 or may be a value agreeing with an opening position of an air inlet and an air outlet or an arrangement position of a refrigerant circuit) in an installation floor space A [$m^2$]. The refrigerant amount M [kg] to be filled falls within the following formula II. Formula II is $M\leq\alpha\times G^{-\beta}\times h_0\times A$. Parameters are as follows; LFL is a lower flammability limit of the flammable refrigerant [$kg/m^3$], A is an installation floor space A [$m^2$] of the indoor unit, G is an assumed maximum leak speed of the refrigerant [kg/h], and $\alpha$ is a positive constant of the refrigerant, mainly correlating to the LFL (determined by an experiment). $\beta$ is a positive constant of the refrigerant, mainly correlating to the density (determined by an experiment).

The method of installing the air-conditioning apparatus according to one embodiment of the present invention uses the air-conditioning apparatus.

According to the air-conditioning apparatus of an embodiment of the present invention, even if the flammable refrigerant being higher in density than air under the atmospheric pressure is used, the air-conditioning apparatus secures safety while filling an effective refrigerant amount.

DETAILED DESCRIPTION

Figure 1:
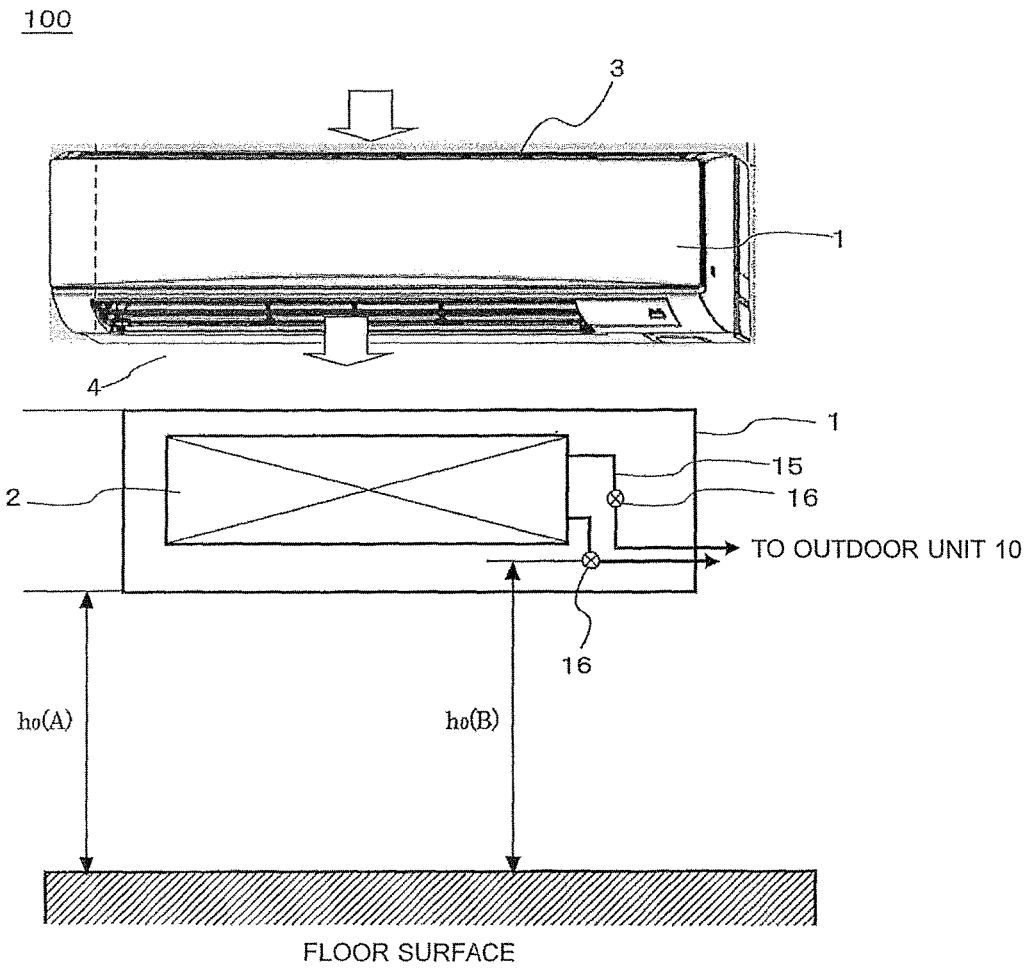
FIG. 1 is a schematic diagram showing an example of an indoor unit composing an air-conditioning apparatus according to Embodiment 1 of the present invention.

Embodiments of the present invention will be described hereinafter with reference to the drawings as necessary. The size of component members in the following drawings including FIG. 1 may be different from that of actual ones. Components given the same reference numerals in the following drawings including FIG. 1 show the same ones or equivalent ones. This is common to all texts in the specification. The form of the components appearing in all texts in the specification is merely an exemplification and is not limited to the description.

Embodiment 1

Figure 2:
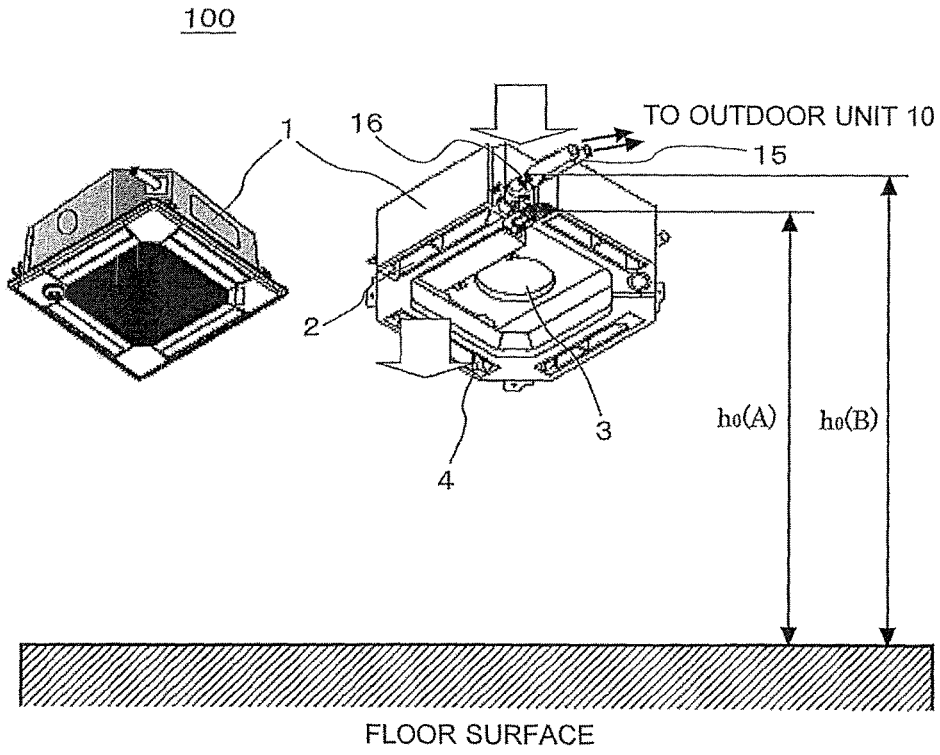
FIG. 2 is a schematic diagram showing another example of an indoor unit composing the air-conditioning apparatus according to Embodiment 1 of the present invention.
Figure 3:
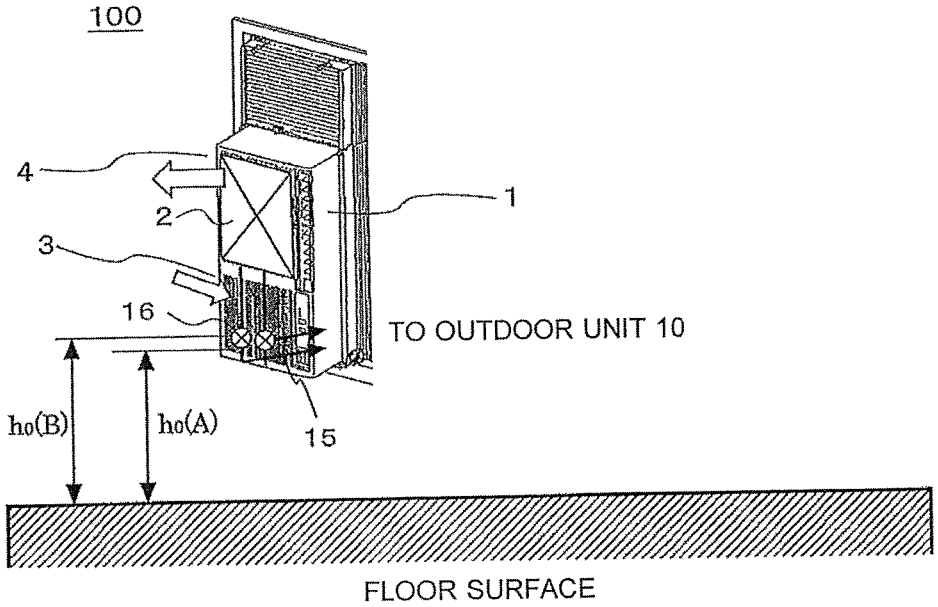
FIG. 3 is a schematic diagram showing yet another example of the indoor unit composing the air-conditioning apparatus according to Embodiment 1 of the present invention.
Figure 4:
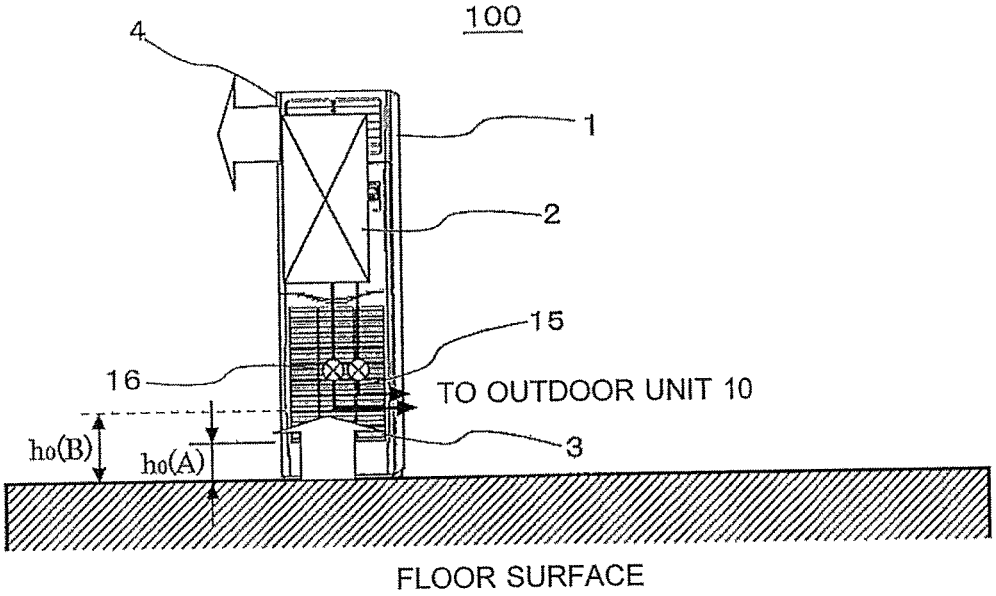
FIG. 4 is a schematic diagram showing yet another example of the indoor unit composing the air-conditioning apparatus according to Embodiment 1 of the present invention.
Figure 5:
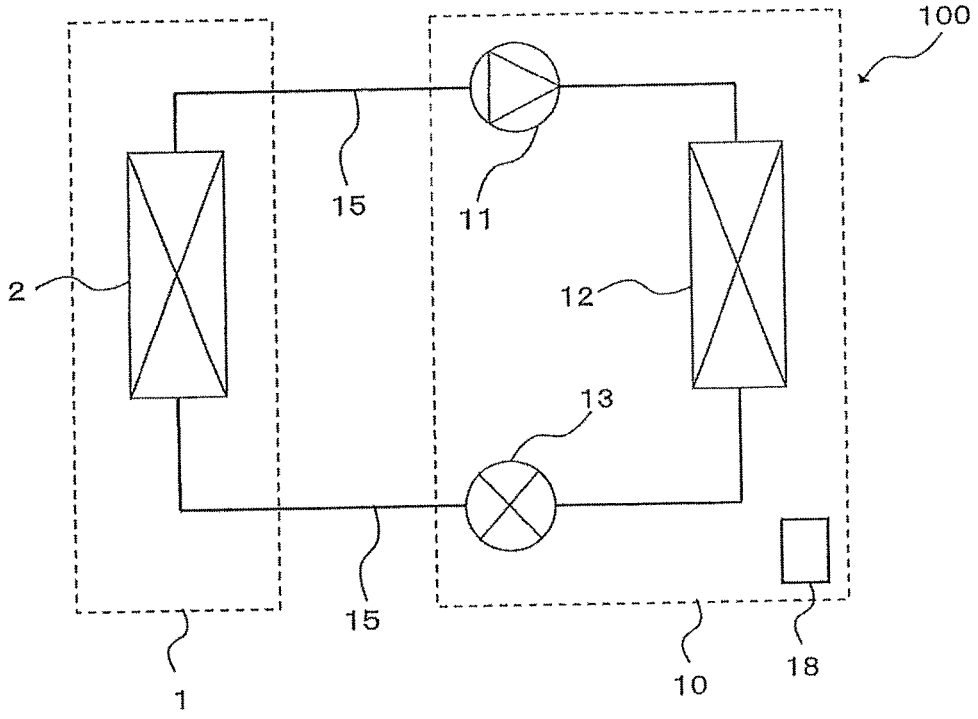
FIG. 5 is a schematic diagram showing a refrigerant circuit configuration of the air-conditioning apparatus according to Embodiment 1 of the present invention.

FIG. 1 is a schematic diagram showing one example of an indoor unit composing an air-conditioning apparatus (hereinafter referred to as air-conditioning apparatus 100) according to Embodiment 1 of the present invention. FIG. 2 is a schematic diagram showing another example of an indoor unit composing the air-conditioning apparatus 100. FIG. 3 is a schematic diagram showing yet another example of the indoor unit composing the air-conditioning apparatus 100. FIG. 4 is a schematic diagram showing yet another example of the indoor unit composing the air-conditioning apparatus 100. FIG. 5 is a schematic diagram showing a refrigerant circuit configuration of the air-conditioning apparatus 100. The indoor unit of the air-conditioning apparatus 100 is mainly described below with reference to FIGS. 1 to 5.

The air-conditioning apparatus 100 has been designed on the assumption that the flammable refrigerant is used and includes an indoor unit 1 shown in FIGS. 1 to 4 and an outdoor unit 10 connected to the indoor unit 1 via a refrigerant pipe 15. FIG. 1 shows a schematic configuration of a wall-type indoor unit 1. FIG. 2 shows a schematic configuration of a ceiling-type indoor unit 1. FIG. 3 shows a schematic configuration of a window-type indoor unit 1. FIG. 4 shows a schematic configuration of a floor-type indoor unit 1. In FIGS. 1 to 4, a separate-type air-conditioning apparatus 100 is shown as an example, however, the air-conditioning apparatus 100 is not limited to this type as long as a heat exchanger 2 is housed in the indoor unit 1, therefore, the air-conditioning apparatus 100 may be of built-in type.

All the indoor units 1 shown in FIGS. 1 to 4 include the heat exchanger (indoor heat exchanger) 2 although methods of installation thereof are different. The indoor unit 1 includes an air inlet 3 for letting room air into the inside of the indoor unit 1 and an air outlet 4 for supplying conditioned air passing through the heat exchanger 2 to the outside of the indoor unit 1. Normally, refrigerant pipes 15 connected to the outdoor unit 10 are provided with refrigerant pipe fittings 16.

The heat exchanger 2 acts as one element of the refrigerant circuit along with a compressor 11 housed in the outdoor unit 10, a heat exchanger 12 and an expansion valve 13 on the outdoor side. When a room space is heated, refrigerant flows through a compressor 11, the heat exchanger 2, an expansion valve 13, and the heat exchanger 12 in this order. In other words, the heat exchanger 2 and the heat exchanger 12 are caused to act as a condenser and an evaporator respectively, and room air passing through the heat exchanger 2 is provided with heating energy to warm the air, thereby performing a heating operation. When a room space is cooled, refrigerant flows through the compressor 11, the heat exchanger 12, the expansion valve 13, and the heat exchanger 2 in this order. In other words, the heat exchanger 2 and the heat exchanger 12 are caused to act as an evaporator and a condenser respectively, and room air removes cooling energy from the refrigerant passing through the heat exchanger 2 to be cooled, thereby performing a cooling operation.

When the refrigerant leaks from the refrigerant circuit in the indoor unit 1, in general, a larger amount of refrigerant leaks from the side lower in height (hereinafter referred to as floor height) of an opening portion such as the air inlet 3 and the air outlet 4. Furthermore, the floor height at the place where leakage occurs may affect. It is presumed that the flammable refrigerant is used in the air-conditioning apparatus 100, so that a flammable area may be generated in a room space depending on a leak amount.

The air-conditioning apparatus 100 includes an input unit to which M, A, LFL, $h_0$, G, $\alpha$, and $\beta$ are input, a unit configured to detect and monitor as to whether the formula II is satisfied (control apparatus 18), and a notification unit configured to making notification when the control apparatus 18 detects that a set threshold value is exceeded. If any improvement cannot be found in a certain period of time after the notification, the control apparatus 18 makes the air-conditioning apparatus 100 inoperative. The control apparatus 18 is composed of hardware such as a circuit device actualizing the above functions, or software for executing on an arithmetic unit such as a microcomputer or a central processing unit (CPU) for example.

Where, $h_0$ is a value basically conforms to IEC60335-2-40. Alternatively, a floor height $h_0$ (A) of the air inlet 3 or the air outlet 4 of the indoor unit 1 whichever is lower may be used.

Alternatively, a floor height $h_0$ (B) of the refrigerant pipe 15 or refrigerant pipe fittings 16 of the indoor unit 1 whichever is lower may be used.

In general, in the wall type (FIG. 1), ceiling type (FIG. 2), and window type (FIG. 3) indoor unit 1 in which the air inlet 3 or the air outlet 4 lies at the lower end portion of the indoor unit 1, $h_0$ (A) is equal to $h_0$ conforming to IEC60335-2-40.

On the other hand, in the floor type indoor unit 1 (FIG. 4), $h_0$ (A) and $h_0$ (B) are different from $h_0$ conforming to IEC60335-2-40, so that an appropriate value is set.

In the present embodiment, the following indoor unit 1 is used as an experimental object.

In "the wall type" shown in FIG. 1, an installation height conforming to IEC60335-2-40, $h_0$=1.8 [m] being equal to the floor height $h_0$ (A) of the air inlet 3 or the air outlet 4 whichever is lower and lower than the floor height $h_0$ (B) of the refrigerant pipe 15 or refrigerant pipe fittings 16 whichever is lower, that is, $h_0=h_0$ (A)$<h_0$ (B).

In "the ceiling type" shown in FIG. 2, an installation height conforming to IEC60335-2-40, $h_0$=2.2 [m]=$h_0$ (A)$<h_0$ (B).

In "the window type" shown in FIG. 3, an installation height conforming to IEC60335-2-40, $h_0$=1.0 [m]=$h_0$ (A)$<h_0$ (B).

In "the floor type" shown in FIG. 4, an installation height conforming to IEC60335-2-40, $h_0$=0.6 [m], $h_0$ (A)=0.15 [m], $h_0$ (B)=0.45 [m].

The minimum value of A is determined to be 4 $m^2$ with reference to a required minimum floor space provided by bylaws. A ceiling height is determined to be 2.2 m or more with reference to Building Standards Act. At least, the indoor unit 1 provided with the heat exchanger 2 is installed at an installation height of $h_0$ or more. Assumed leak speeds are taken as 5 kg/h, 10 kg/h, and 75 kg/h with reference to "Environment and New Refrigerant, International Symposium 2012" on page 98, issued by (corporate juridical person) The Japan Refrigeration and Air Conditioning Industry Association (JRAIA), and a median of 10 kg/h is taken as a standard value. The above reference describes that the majority of refrigerant leakage accidents occurred at a leak speed of 1 kg/h or less. Safety can therefore be secured at a leak speed of 5 kg/h.

The lower flammability limit (LFL) described in IEC60335-2-40 complies therewith. For example, LFL of R32=0.306 [kg/$m^3$], LFL of propane (R290)=0.038 [kg/$m^3$]. If IEC60335-2-40 describes nothing about the above, speculation is made from documents or experiments. HFO-1234yf is taken as 0.294 [kg/$m^3$] because IEC60335-2-40 describes nothing about it.

The constants $\alpha$ and $\beta$ are determined by refrigerant leak experiment results described below, but basically depend on refrigerant species. The constant $\alpha$ is influenced mainly by LFL and the constant $\beta$ is influenced mainly by density (molecular weight), but details are not clear.

Figure 6:
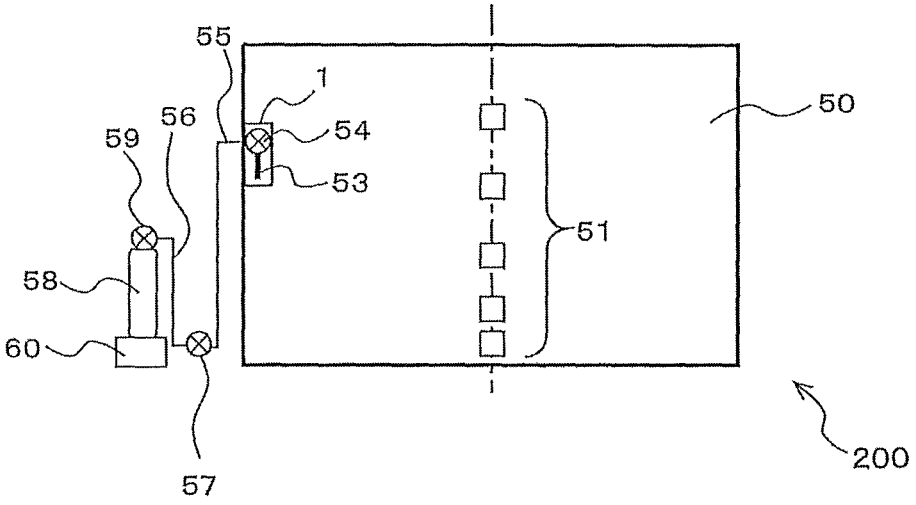
FIG. 6 is a schematic diagram showing a schematic configuration of an experiment apparatus used for evaluating safety of an indoor unit of the air-conditioning apparatus according to Embodiment 1 of the present invention.

FIG. 6 is a schematic diagram showing a schematic configuration of an experiment apparatus 200 used for evaluating safety (flammable area generation behavior) of the indoor unit 1 and determining the constants $\alpha$ and $\beta$. The evaluation of safety of the indoor unit 1 is described below and the determination of range of refrigerant amount M[kg] is also described.

As shown in FIG. 6, an enclosed space 50 is produced. The enclosed space 50 is produced such that a prepared veneer board of about 10 mm in thickness is glued to satisfy predetermined floor space and ceiling height. The enclosed space 50 can be produced at a floor space (inside dimension) of 3 to 87.3 jyo (a unit of area in Japan, 2 jyo=3.3 $m^2$, so that 3 to 87.3 jyo=4.95 $m^2$ to 144 $m^2$) and a ceiling height of 2.2 m to 2.5 m. A space between the veneer boards is filled with silicone adhesive and gaps between doors are sealed with aluminum tape.

The indoor unit 1 leaking the refrigerant is installed in the enclosed space 50.

FIG. 6 illustrates a state where the wall-type indoor unit 1 is installed as one example.

A gas density sensor 51 is arranged at a predetermined height in the enclosed space 50. As an example, FIG. 6 shows a state where five gas density sensors 51 are arranged at upper and lower portions at the center of the enclosed space 50, however, the positions and the number of the gas density sensor 51 are increased depending on forms and arrangement positions of the indoor unit 1 and the shape of the enclosed space 50 to identify the position where the maximum gas density is obtained and then measurement is conducted. At that time, the gas density sensors 51 were previously arranged at several positions including the position before the indoor unit 1 and measurement is conducted. Confirmation was made that no problem is occurred when the gas density at the center part of the space is taken as a representative value.

Inside the indoor unit 1, a general capillary 53 is connected to a charge hose 55 by an opening and closing opening and closing valve 54. At this time, the charge hose 55 is connected to a charge hose 56 by an opening and closing opening and closing valve 57. The charge hose 55 is arranged to communicate inside and outside the enclosed space 50. The opening and closing valve 54 should lie inside the enclosed space 50 and the opening and closing valve 57 should lie outside the enclosed space 50. Furthermore, another end of the charge hose 56 that is not connected to the opening and closing valve 57 is connected to a main tap 59 of a refrigerant cylinder 58.

The capillary 53 functions to adjust a leakage speed in leaking the refrigerant. A general copper capillary may be used as it is, or a partially processed capillary may be used. A general TASCO TA-136A, for example, may be used as the charge hoses 55 and 56.

The opening and closing valve 57 is kept closed in a state where the opening and closing valve 57 is adjusted to the leakage speed targeted at a preliminary experiment and then the main tap 59 is opened. This state is kept, and the refrigerant cylinder 58 is placed on an electronic platform scale 60. While change in weight of the refrigerant cylinder 58 is always recorded using a personal computer, the opening and closing valve 57 is opened.

Thus, the refrigerant is leaked into the enclosed space 50 at the targeted leakage speed. The leakage speed can be estimated as an average leakage speed V [kg/h] from a gradient that temporal change in the weight of the refrigerant cylinder 58 is linearly approximated.

The preliminary experiment is performed using an experiment apparatus 200. The leakage speed can be adjusted by specifications (inside diameter and length) of the capillary 53 and a degree to which the opening and closing valve 54 is opened.

A refrigerant leakage amount can be adjusted by closing the opening and closing valve 57 when the electronic platform scale 60 reads the targeted weight.

The gas density sensors 51 are set at a predetermined height in the center part of the enclosed space 50. Detection results are continuously recorded by a personal computer. A gas sensor VT-1 for R32 (produced by New Cosmos Electric., Co., Ltd.), for example, may be used.

In the present embodiment, 14.4 vol % being the volume density LFL of R32 conforming to the IEC60335-2-40 is used as an index to display the volume density by the gas density sensor used for the R32. When the maximum density of R32 reaches 14.4 vol % or more, "present" is given as an evidence of generating a flammable area, and when the maximum density of R32 is less than 14.4 vol %, "absent" is given.

Confirmation was made that the flammable area is not generated in a range satisfying the formula I, however, as described above when discussing Patent Literature 1, the refrigerant amount may be excessively restricted, so that the confirmation is described as a comparative example.

Reason given that the example is performed in the case where leakage is not occurred from the actual apparatus (the refrigeration cycle apparatus such as the air-conditioning apparatus) as follows.

In the actual apparatus, almost all of refrigerant is stored in a compressor. For this reason, when the refrigerant is leaked from the actual apparatus into the room, the refrigerant will leak from the compressor. In this case, refrigerant gas leaking at a high speed because of high pressure in starting leakage lowers in internal pressure of the refrigerant circuit according as the refrigerant amount remained in a refrigeration cycle apparatus decreases, and the leakage speed is also lowered. Thereby, the leakage speed is changed by the leakage refrigerant amount, and the leakage amount is not known because the total amount is not discharged, which makes it difficult to obtain quantitative data for discussing safety.

The preliminary experiment was performed before the present embodiment is made. When the refrigerant whose amount is equal to that in the method shown in the present embodiment is leaked at substantially the same speed, confirmation was made that a room density in leaking the refrigerant from the actual apparatus was lower.

Example 1

Tables 1 to 9 show a state of generation of a flammable area in leaking the R32, in a case where the wall-type indoor unit 1 is installed to one wall surface of the enclosed space 50 with the floor space (inside dimension) of 12 $m^2$, 36 $m^2$, and 64 $m^2$ and a ceiling height of 2.5 m so that the lower end part of the indoor unit 1 has a floor height of 1.8 m, a leakage refrigerant amount is taken as 0.5 kg to 70.0 kg, an average leakage speed V is taken as 5 kg/h, 10 kg/h, and 75 kg/h, and installation floor heights for the gas density sensors are taken as 50 mm, 100 mm, 250 mm, 500 mm, 1000 mm, 1500 mm, and 2000 mm.

TABLE 1

| | EXAMPLE | | | | | | |
|---|---|---|---|---|---|---|---|
| | COMPARATIVE EXAMPLE 1 | COMPARATIVE EXAMPLE 2 | COMPARATIVE EXAMPLE 3 | COMPARATIVE EXAMPLE 4 | COMPARATIVE EXAMPLE 5 | COMPARATIVE EXAMPLE 6 | EXAMPLE 1 |
| INSTALLATION HEIGHT [m] | 1.8 | 1.8 | 1.8 | 1.8 | 1.8 | 1.8 | 1.8 |
| V [kg/h] | 5 | 5 | 5 | 5 | 5 | 5 | 5 |
| M [kg] | 0.5 | 1.0 | 1.5 | 2.0 | 2.5 | 3.0 | 3.6 |
| A [$m^2$] | 12 | 12 | 12 | 12 | 12 | 12 | 12 |
| M/A [kg/$m^2$] | 0.042 | 0.083 | 0.125 | 0.167 | 0.208 | 0.250 | 0.300 |
| EXISTENCE OF FLAMMABLE AREA | present | present | present | present | present | present | present |

| | EXAMPLE | | | | | |
|---|---|---|---|---|---|---|
| | EXAMPLE 2 | EXAMPLE 3 | EXAMPLE 4 | EXAMPLE 5 | EXAMPLE 6 | COMPARATIVE EXAMPLE 8 |
| INSTALLATION HEIGHT [m] | 1.8 | 1.8 | 1.8 | 1.8 | 1.8 | 1.8 |
| V [kg/h] | 5 | 5 | 5 | 5 | 5 | 5 |
| M [kg] | 4.0 | 4.2 | 5.0 | 7.5 | 12.8 | 13.5 |
| A [$m^2$] | 12 | 12 | 12 | 12 | 12 | 12 |
| M/A [kg/$m^2$] | 0.333 | 0.350 | 0.416 | 0.625 | 1.067 | 1.125 |
| EXISTENCE OF FLAMMABLE AREA | present | present | present | present | present | absent |

TABLE 2

| | EXAMPLE | | | | | | |
|---|---|---|---|---|---|---|---|
| | COMPARATIVE EXAMPLE 9 | COMPARATIVE EXAMPLE 10 | COMPARATIVE EXAMPLE 11 | COMPARATIVE EXAMPLE 12 | COMPARATIVE EXAMPLE 13 | COMPARATIVE EXAMpLE 14 | EXAMPLE 7 |
| INSTALLATION HEIGHT [m] | 1.8 | 1.8 | 1.8 | 1.8 | 1.8 | 1.8 | 1.8 |
| V [kg/h] | 10 | 10 | 10 | 10 | 10 | 10 | 10 |
| M [kg] | 0.5 | 1.0 | 1.5 | 2.0 | 2.5 | 3.0 | 3.6 |
| A [$m^2$] | 12 | 12 | 12 | 12 | 12 | 12 | 12 |

TABLE 2-continued

| | | | | | | | |
|---|---|---|---|---|---|---|---|
| M/A [kg/m$^2$] | 0.042 | 0.083 | 0.125 | 0.167 | 0.208 | 0.250 | 0.300 |
| EXISTENCE OF FLAMMABLE AREA | present | present | present | present | present | present | present |

| | EXAMPLE | | | | |
|---|---|---|---|---|---|
| | EXAMPLE 8 | EXAMPLE 9 | EXAMPLE 11 | EXAMPLE 12 | COMPARATIVE EXAMPLE 15 |
| INSTALLATION HEIGHT [m] | 1.8 | 1.8 | 1.8 | 1.8 | 1.8 |
| V [kg/h] | 10 | 10 | 10 | 10 | 10 |
| M [kg] | 4.0 | 4.5 | 5.6 | 9.1 | 9.5 |
| A [m$^2$] | 12 | 12 | 12 | 12 | 12 |
| M/A [kg/m$^2$] | 0.333 | 0.375 | 0.467 | 0.758 | 0.792 |
| EXISTENCE OF FLAMMABLE AREA | present | present | present | present | absent |

TABLE 3

| | EXAMPLE | | | | | | |
|---|---|---|---|---|---|---|---|
| | COMPARATIVE EXAMPLE 16 | COMPARATIVE EXAMPLE 17 | COMPARATIVE EXAMPLE 18 | COMPARATIVE EXAMPLE 19 | COMPARATIVE EXAMPLE 20 | COMPARATIVE EXAMPLE 21 | EXAMPLE 12 |
| INSTALLATION HEIGHT [m] | 1.8 | 1.8 | 1.8 | 1.8 | 1.8 | 1.8 | 1.8 |
| V [kg/h] | 75 | 75 | 75 | 75 | 75 | 75 | 75 |
| M [kg] | 0.5 | 1.0 | 1.5 | 2.0 | 2.5 | 3.0 | 3.6 |
| A [m$^2$] | 12 | 12 | 12 | 12 | 12 | 12 | 12 |
| M/A [kg/m$^2$] | 0.042 | 0.083 | 0.125 | 0.167 | 0.208 | 0.250 | 0.300 |
| EXISTENCE OF FLAMMABLE AREA | present | present | present | present | present | present | present |

| | EXAMPLE | | | | |
|---|---|---|---|---|---|
| | EXAMPLE 13 | EXAMPLE 14 | COMPARATIVE EXAMPLE 22 | COMPARATIVE EXAMPLE 23 | COMPARATIVE EXAMPLE 24 |
| INSTALLATION HEIGHT [m] | 1.8 | 1.8 | 1.8 | 1.8 | 1.8 |
| V [kg/h] | 75 | 75 | 75 | 75 | 75 |
| M [kg] | 4.0 | 4.2 | 5.0 | 7.5 | 10.0 |
| A [m$^2$] | 12 | 12.0 | 12 | 12 | 12 |
| M/A [kg/m$^2$] | 0.333 | 0.350 | 0.416 | 0.625 | 0.833 |
| EXISTENCE OF FLAMMABLE AREA | present | present | absent | absent | absent |

TABLE 4

| | EXAMPLE | | | | | |
|---|---|---|---|---|---|---|
| | COMPARATIVE EXAMPLE 25 | COMPARATIVE EXAMPLE 26 | COMPARATIVE EXAMPLE 27 | EXAMPLE 15 | EXAMPLE 6 | EXAMPLE 17 |
| INSTALLATION HEIGHT [m] | 1.8 | 1.8 | 1.8 | 1.8 | 1.8 | 1.8 |
| V [kg/h] | 5 | 5 | 5 | 5 | 5 | 5 |
| M [kg] | 1.5 | 3.0 | 4.5 | 6.2 | 7.5 | 9.0 |
| A [m$^2$] | 36 | 36 | 36 | 36 | 36 | 36 |
| M/A [kg/m$^2$] | 0.042 | 0.083 | 0.125 | 0.172 | 0.208 | 0.250 |

TABLE 4-continued

| | | | | | | |
|---|---|---|---|---|---|---|
| EXISTENCE OF FLAMMABLE AREA | present | present | present | present | present | present |

| | EXAMPLE | | | | | | |
|---|---|---|---|---|---|---|---|
| | EXAMPLE 18 | EXAMPLE 19 | EXAMPLE 20 | EXAMPLE 21 | EXAMPLE 22 | EXAMPLE 23 | COMPARATIVE EXAMPLE 28 |
| INSTALLATION HEIGHT [m] | 1.8 | 1.8 | 1.8 | 1.8 | 1.8 | 1.8 | 1.8 |
| V [kg/h] | 5 | 5 | 5 | 5 | 5 | 5 | 5 |
| M [kg] | 10.8 | 12.0 | 12.6 | 15.0 | 22.5 | 38.2 | 38.5 |
| A [$m^2$] | 36 | 36 | 36 | 36 | 36 | 36 | 36 |
| M/A [$kg/m^2$] | 0.300 | 0.333 | 0.350 | 0.416 | 0.625 | 1.061 | 1.069 |
| EXISTENCE OF FLAMMABLE AREA | present | present | present | present | present | present | absent |

TABLE 5

| | EXAMPLE | | | | | |
|---|---|---|---|---|---|---|
| | COMPARATIVE EXAMPLE 29 | COMPARATIVE EXAMPLE 30 | COMPARATIVE EXAMPLE 31 | EXAMPLE 24 | EXAMPLE 25 | EXAMPLE 26 |
| INSTALLATION HEIGHT [m] | 1.8 | 1.8 | 1.8 | 1.8 | 1.8 | 1.8 |
| V [kg/h] | 10 | 10 | 10 | 10 | 10 | 10 |
| M [kg] | 1.5 | 3.0 | 4.5 | 6.2 | 7.5 | 9.0 |
| A [$m^2$] | 36 | 36 | 36 | 36 | 36 | 36 |
| M/A [$kg/m^2$] | 0.042 | 0.083 | 0.125 | 0.172 | 0.208 | 0.250 |
| EXISTENCE OF FLAMMABLE AREA | present | present | present | present | present | present |

| | EXAMPLE | | | | | | |
|---|---|---|---|---|---|---|---|
| | EXAMPLE 27 | EXAMPLE 28 | EXAMPLE 29 | EXAMPLE 30 | EXAMPLE 31 | COMPARATIVE EXAMPLE 32 | COMPARATIVE EXAMPLE 33 |
| INSTALLATION HEIGHT [m] | 1.8 | 1.8 | 1.8 | 1.8 | 1.8 | 1.8 | 1.8 |
| V [kg/h] | 10 | 10 | 10 | 10 | 10 | 10 | 10 |
| M [kg] | 10.8 | 12.0 | 12.6 | 15.0 | 27.3 | 28.0 | 30.0 |
| A [$m^2$] | 36 | 36 | 36 | 36 | 36 | 36 | 36 |
| M/A [$kg/m^2$] | 0.300 | 0.333 | 0.350 | 0.416 | 0.758 | 0.778 | 0.833 |
| EXISTENCE OF FLAMMABLE AREA | present | present | present | present | present | absent | absent |

TABLE 6

| | EXAMPLE | | | | | |
|---|---|---|---|---|---|---|
| | COMPARATIVE EXAMPLE 34 | COMPARATIVE EXAMPLE 35 | COMPARATIVE EXAMPLE 36 | EXAMPLE 32 | EXAMPLE 33 | EXAMPLE 34 |
| INSTALLATION HEIGHT [m] | 1.8 | 1.8 | 1.8 | 1.8 | 1.8 | 1.8 |
| V [kg/h] | 75 | 75 | 75 | 75 | 75 | 75 |
| M [kg] | 1.5 | 3.0 | 4.5 | 6.2 | 7.5 | 9.0 |
| A [$m^2$] | 36 | 36 | 36 | 36 | 36 | 36 |
| M/A [$kg/m^2$] | 0.042 | 0.083 | 0.125 | 0.172 | 0.208 | 0.250 |

TABLE 6-continued

| | | | | | | |
|---|---|---|---|---|---|---|
| EXISTENCE OF FLAMMABLE AREA | present | present | present | present | present | present |

| | EXAMPLE | | | | |
|---|---|---|---|---|---|
| | EXAMPLE 35 | EXAMPLE 36 | EXAMPLE 37 | COMPARATIVE EXAMPLE 37 | COMPARATIVE EXAMPLE 38 |
| INSTALLATION HEIGHT [m] | 1.8 | 1.8 | 1.8 | 1.8 | 1.8 |
| V [kg/h] | 75 | 75 | 75 | 75 | 75 |
| M [kg] | 10.8 | 12.0 | 12.6 | 15.0 | 22.5 |
| A [$m^2$] | 36 | 36 | 36 | 36 | 36 |
| M/A [$kg/m^2$] | 0.300 | 0.333 | 0.350 | 0.416 | 0.625 |
| EXISTENCE OF FLAMMABLE AREA | present | present | present | absent | absent |

TABLE 7

| | EXAMPLE | | | | | |
|---|---|---|---|---|---|---|
| | COMPARATIVE EXAMPLE 39 | COMPARATIVE EXAMPLE 40 | COMPARATIVE EXAMPLE 41 | EXAMPLE 38 | EXAMPLE 39 | EXAMPLE 40 |
| INSTALLATION HEIGHT [m] | 1.8 | 1.8 | 1.8 | 1.8 | 1.8 | 1.8 |
| V [kg/h] | 5 | 5 | 5 | 5 | 5 | 5 |
| M [kg] | 4.0 | 5.6 | 6.0 | 8.2 | 10.5 | 13.0 |
| A [$m^2$] | 64 | 64 | 64 | 64 | 64 | 64 |
| M/A [$kg/m^2$] | 0.063 | 0.088 | 0.093 | 0.128 | 0.164 | 0.203 |
| EXISTENCE OF FLAMMABLE AREA | present | present | present | present | present | present |

| | EXAMPLE | | | | | | |
|---|---|---|---|---|---|---|---|
| | EXAMPLE 41 | EXAMPLE 42 | EXAMPLE 43 | EXAMPLE 44 | EXAMPLE 45 | EXAMPLE 46 | COMPARATIVE EXAMPLE 42 |
| INSTALLATION HEIGHT [m] | 1.8 | 1.8 | 1.8 | 1.8 | 1.8 | 1.8 | 1.8 |
| V [kg/h] | 5 | 5 | 5 | 5 | 5 | 5 | 5 |
| M [kg] | 16.0 | 22.4 | 24.0 | 26.6 | 40.0 | 68.0 | 70.0 |
| A [$m^2$] | 64 | 64 | 64 | 64 | 64 | 64 | 64 |
| M/A [$kg/m^2$] | 0.250 | 0.350 | 0.375 | 0.416 | 0.625 | 1.063 | 1.094 |
| EXISTENCE OF FLAMMABLE AREA | present | present | present | present | present | present | absent |

TABLE 8

| | EXAMPLE | | | | | |
|---|---|---|---|---|---|---|
| | COMPARATIVE EXAMPLE 43 | COMPARATIVE EXAMPLE 44 | COMPARATIVE EXAMPLE 45 | EXAMPLE 47 | EXAMPLE 48 | EXAMPLE 49 |
| INSTALLATION HEIGHT [m] | 1.8 | 1.8 | 1.8 | 1.8 | 1.8 | 1.8 |
| V [kg/h] | 10 | 10 | 10 | 10 | 10 | 10 |
| M [kg] | 4.0 | 5.6 | 6.0 | 8.2 | 10.5 | 13.0 |
| A [$m^2$] | 64 | 64 | 64 | 64 | 64 | 64 |
| M/A [$kg/m^2$] | 0.063 | 0.088 | 0.093 | 0.128 | 0.164 | 0.203 |

TABLE 8-continued

| | | | | | | |
|---|---|---|---|---|---|---|
| EXISTENCE OF FLAMMABLE AREA | present | present | present | present | present | present |

| | EXAMPLE | | | | | |
|---|---|---|---|---|---|---|
| | EXAMPLE 50 | EXAMPLE 51 | EXAMPLE 52 | EXAMPLE 53 | EXAMPLE 54 | COMPARATIVE EXAMPLE 46 |
| INSTALLATION HEIGHT [m] | 1.8 | 1.8 | 1.8 | 1.8 | 1.8 | 1.8 |
| V [kg/h] | 10 | 10 | 10 | 10 | 10 | 10 |
| M [kg] | 16.0 | 22.4 | 24.0 | 26.6 | 48.5 | 49.5 |
| A [$m^2$] | 64 | 64 | 64 | 64 | 64 | 64 |
| M/A [$kg/m^2$] | 0.250 | 0.350 | 0.375 | 0.416 | 0.758 | 0.773 |
| EXISTENCE OF FLAMMABLE AREA | present | present | present | present | present | absent |

TABLE 9

| | EXAMPLE | | | | | |
|---|---|---|---|---|---|---|
| | COMPARATIVE EXAMPLE 47 | COMPARATIVE EXAMPLE 48 | COMPARATIVE EXAMPLE 49 | EXAMPLE 55 | EXAMPLE 56 | EXAMPLE 57 |
| INSTALLATION HEIGHT [m] | 1.8 | 1.8 | 1.8 | 1.8 | 1.8 | 1.8 |
| V [kg/h] | 75 | 75 | 75 | 75 | 75 | 75 |
| M [kg] | 4.0 | 5.6 | 6.0 | 8.2 | 10.5 | 13.0 |
| A [$m^2$] | 64 | 64 | 64 | 64 | 64 | 64 |
| M/A [$kg/m^2$] | 0.063 | 0.088 | 0.093 | 0.128 | 0.164 | 0.203 |
| EXISTENCE OF FLAMMABLE AREA | present | present | present | present | present | present |

| | EXAMPLE | | | |
|---|---|---|---|---|
| | EXAMPLE 58 | EXAMPLE 59 | COMPARATIVE EXAMPLE 50 | COMPARATIVE EXAMPLE 51 |
| INSTALLATION HEIGHT [m] | 1.8 | 1.8 | 1.8 | 1.8 |
| V [kg/h] | 75 | 75 | 75 | 75 |
| M [kg] | 16.0 | 22.4 | 24.0 | 26.6 |
| A [$m^2$] | 64 | 64 | 64 | 64 |
| M/A [$kg/m^2$] | 0.250 | 0.350 | 0.375 | 0.416 |
| EXISTENCE OF FLAMMABLE AREA | present | present | absent | absent |

The examples are summarized in table 10 which lists an allowable refrigerant amount without a flammable area (M upper limit) and a relationship between $m_{max}$ conforming to IEC60335-2-40 and the installation floor space A (M upper limit/A and $m_{max}$/A). Incidentally, $m_{max}$/A is as follows in accordance with the formula I.

$$m_{max} = 2.5 \times (LFL)^{1.25} \times h_0 \times (A)^{0.5} \quad \text{(Formula III)}$$
$$= 2.5 \times (0.306)^{1.25} \times h_0 \times (A)^{0.5}$$
$$= 0.569 \times h_0 \times (A)^{0.5}$$

Now, $h_0$=1.8 m, so that $m_{max}=1.024\times(A)^{0.5}$.
When A=12 $m^2$, $m_{max}=1.02\times12^{0.5}=3.53$ [kg].
Therefore, $m_{max}$/A=3.53 [kg]/12 [$m^2$]=0.294 [$kg/m^2$].
When A=36 $m^2$, $m_{max}=1.02\times36^{0.5}=6.12$ [kg].
Therefore, $m_{max}$/A=6.12/36=0.170 [$kg/m^2$].
When A=64 $m^2$, $m_{max}=1.02\times64^{0.5}=8.16$ [kg].
Therefore, $m_{max}$/A=8.16/64=0.128 [$kg/m^2$].

TABLE 10

| | | M upper limit or $m_{max}$ with respect to $h_0$ = 1.8 [m] ($m_{max}$/A or M upper limit/A in parenthesis) | | |
|---|---|---|---|---|
| | | FLOOR SPACE A | | |
| | | 12 $m^2$ | 36 $m^2$ | 64 $m^2$ |
| $m_{max}$ ($h_0$ = 1.8 m | V UNRELATED | 3.53 kg (0.294 $kg/m^2$) | 6.12 kg (0.170 $kg/m^2$) | 8.16 kg (0.128 $kg/m^2$) |

TABLE 10-continued

| M upper limit or $m_{max}$ with respect to $h_0$ = 1.8 [m] ($m_{max}$/A or M upper limit/A in parenthesis) | | FLOOR SPACE A | | |
|---|---|---|---|---|
| | | 12 $m^2$ | 36 $m^2$ | 64 $m^2$ |
| IN FORMULA III) | | | | |
| M UPPER LIMIT ($h_0$ = 1.8 m) | V = 5 kg/h | 12.8 kg (1.067 kg/$m^2$) | 38.2 kg (1.061 kg/$m^2$) | 68.0 kg (1.063 kg/$m^2$) |
| | V = 10 kg/h | 9.1 kg (0.758 kg/$m^2$) | 27.3 kg (0.758 kg/$m^2$) | 48.5 kg (0.758 kg/$m^2$) |
| | V = 75 kg/h | 4.2 kg (0.350 kg/$m^2$) | 12.6 kg (0.350 kg/$m^2$) | 22.4 kg (0.350 kg/$m^2$) |

Table 10 tells us the following.

(1) Leakage of the refrigerant in excess of $m_{max}$ will not generate the flammable area.

(2) M upper limit needs to be decreased according as V increases. In other words, M upper limit needs to be decreased according as G increases.

(3) M upper limit/A (synonymous with "maximum value of M/A" in case A is constant) is constant in case V is constant, i.e., in case G is constant.

The above tells us that M/A has only to be taken as an index to perform management so that the flammable area is not generated. That is, at $h_0$=1.8 [m], and at G=5 [kg/h], (the maximum value of M/A)=1.061 [kg/$m^2$]; at G=10 [kg/h], (the maximum value of M/A)=0.75 [kg/$m^2$]; and at G=75 [kg/h], (the maximum value of M/A)=0.350 [kg/$m^2$].

It is easily assumable that the greater an assumed maximum leakage speed G, the greater the safety.

Example 2

Table 11 also shows a state of generation of a flammable area in leaking the R32, in a case where the ceiling-type indoor unit 1 is installed to the center of the ceiling of the enclosed space 50 with the floor space (inside dimension) of 12 $m^2$, 36 $m^2$, and 64 $m^2$ so that the lower end part of the indoor unit 1 has a floor height of 2.2 m, a leakage refrigerant amount is taken as 0.5 kg to 53.4 kg, an average leakage speed V is taken as 5 kg/h, 10 kg/h, and 75 kg/h, and installation floor heights for the gas density sensors are taken as 50 mm, 100 mm, 250 mm, 500 mm, 1000 mm, 1500 mm, and 2000 mm.

TABLE 11

| M upper limit or $m_{max}$ with respect to $h_0$ = 2.2 [m] ($m_{max}$/A or M upper limit/A in parenthesis) | | FLOOR SPACE A | | |
|---|---|---|---|---|
| | | 12 $m^2$ | 36 $m^2$ | 64 $m^2$ |
| $m_{max}$ ($h_0$ = 2.2 m IN FORMULA III) | V UNRELATED | 4.34 kg (0.362 kg/$m^2$) | 7.51 kg (0.209 kg/$m^2$) | 10.0 kg (0.156 kg/$m^2$) |
| M UPPER LIMIT ($h_0$ = 2.2 m) | V = 5 kg/h | 15.6 kg (1.30 kg/$m^2$) | 47.2 kg (1.31 kg/$m^2$) | 83.5 kg (1.31 kg/$m^2$) |
| | V = 10 kg/h | 11.1 kg (0.925 kg/$m^2$) | 35.5 kg (0.931 kg/$m^2$) | 59.2 kg (0.925 kg/$m^2$) |
| | V = 75 kg/h | 5.10 kg (0.425 kg/$m^2$) | 15.3 kg (0.425 kg/$m^2$) | 27.1 kg (0.423 kg/$m^2$) |

The above tells us a tendency similar to Example 1. That is, at $h_0$=2.2 m and at G=5 [kg/h], (the maximum value of M/A)=1.30 [kg/$m^2$]; at G=10 [kg/h], (the maximum value of M/A)=0.925 [kg/$m^2$]; and at G=75 [kg/h], (the maximum value of M/A)=0.423 [kg/$m^2$].

Example 3

Table 12 also shows a state of generation of a flammable area in leaking the R32, in a case where the window-type indoor unit 1 is installed to a part of the wall of the enclosed space 50 with the floor space (inside dimension) of 12 $m^2$, 36 $m^2$, and 64 $m^2$ so that the lower end part of the indoor unit 1 has a floor height of 1.0 m, a leakage refrigerant amount is taken as 0.5 kg to 53.4 kg, an average leakage speed V is taken as 5 kg/h, 10 kg/h, and 75 kg/h, and installation floor heights for the gas density sensors are taken as 50 mm, 100 mm, 250 mm, 500 mm, 1000 mm, 1500 mm, and 2000 mm.

TABLE 12

| M upper limit or $m_{max}$ with respect to $h_0$ = 1.0 [m] ($m_{max}$/A or M upper limit/A in parenthesis) | | FLOOR SPACE A | | |
|---|---|---|---|---|
| | | 12 $m^2$ | 36 $m^2$ | 64 $m^2$ |
| $m_{max}$ ($h_0$ = 1.0 m IN FORMULA III) | V UNRELATED | 1.97 kg (0.164 kg/$m^2$) | 3.41 kg (0.0947 kg/$m^2$) | 4.55 kg (0.0710 kg/$m^2$) |
| M UPPER LIMIT ($h_0$ = 1.0 m) | V = 5 kg/h | 7.09 kg (0.591 kg/$m^2$) | 21.3 kg (0.592 kg/$m^2$) | 37.8 kg (0.591 kg/$m^2$) |
| | V = 10 kg/h | 5.05 kg (0.421 kg/$m^2$) | 15.2 kg (0.422 kg/$m^2$) | 27.1 kg (0.423 kg/$m^2$) |
| | V = 75 kg/h | 2.34 kg (0.195 kg/$m^2$) | 6.90 kg (0.192 kg/$m^2$) | 12.3 kg (0.192 kg/$m^2$) |

The above tells us a tendency similar to Examples 1 and 2. That is, at $h_0$=1.0 [m] and at G=5 [kg/h], (the maximum value of M/A)=0.591 [kg/$m^2$]; at G=10 [kg/h], (the maximum value of M/A)=0.421 [kg/$m^2$]; and at G=75 [kg/h], (the maximum value of M/A)=0.192 [kg/$m^2$].

Example 4

The floor-type indoor unit 1 shown in FIG. 4 was installed on the floor surface of the enclosed space 50 with the floor space (inside dimension) of 12 $m^2$, 36 $m^2$, and 64 $m^2$ ($h_0$=0.6 [m] conforming to IEC60335-2-40). The lower end of the capillary 53 in the floor-type indoor unit 1 shown in FIG. 6 is fixed to the right lateral space of the heat exchanger 2 shown in FIG. 4 by a tape at a floor height $h_0$ (B)=0.6 [m], 0.45 [m] or 0.15 [m] of the refrigerant pipe 15 or the refrigerant pipe fittings 16 of the indoor unit 1 whichever is lower. Tables 13, 14, and 15 also show a state of generation of a flammable area in leaking the R32, in a case where a leakage refrigerant amount is taken as 0.5 kg to 38.5 kg, an average leakage speed V is taken as 5 kg/h, 10 kg/h, and 75 kg/h, and floor heights for the gas density sensors are taken as 50 mm, 100 mm, 250 mm, 500 mm, 1000 mm, 1500 mm, and 2000 mm.

TABLE 13

$m_{max}$ with respect to $h_0$ = 0.6 [m] or M upper limit with respect to $h_0$ (B) = 0.6 [m] ($m_{max}$/A or M upper limit/A in parenthesis)

| | | FLOOR SPACE A | | |
|---|---|---|---|---|
| | | 12 $m^2$ | 36 $m^2$ | 64 $m^2$ |
| $m_{max}$ ($h_0$ = 0.6 m IN FORMULA III) | V UNRELATED | 1.18 kg (0.0983 kg/$m^2$) | 2.05 kg (0.0569 kg/$m^2$) | 2.73 kg (0.0427 kg/$m^2$) |
| M UPPER LIMIT ($h_0$ (B) = 0.6 m) | V = 5 kg/h | 4.30 kg (0.358 kg/$m^2$) | 12.8 kg (0.356 kg/$m^2$) | 22.7 kg (0.355 kg/$m^2$) |
| | V = 10 kg/h | 3.05 kg (0.254 kg/$m^2$) | 9.07 kg (0.252 kg/$m^2$) | 16.3 kg (0.255 kg/$m^2$) |
| | V = 75 kg/h | 1.40 kg (0.117 kg/$m^2$) | 4.14 kg (0.115 kg/$m^2$) | 7.62 kg (0.119 kg/$m^2$) |

TABLE 14

$m_{max}$ with respect to $h_0$ = 0.6 [m] or M upper limit with respect to $h_0$ (B) = 0.45[m] ($m_{max}$/A or M upper limit/A in parenthesis)

| | | FLOOR SPACE A | | |
|---|---|---|---|---|
| | | 64 $m^2$ | 120 $m^2$ | 144 $m^2$ |
| $m_{max}$ ($h_0$ = 0.6 m IN FORMULA III) | V UNRELATED | 2.73 kg (0.0427 kg/$m^2$) | 3.74 kg (0.0312 kg/$m^2$) | 4.10 kg (0.0285 kg/$m^2$) |
| M UPPER LIMIT ($h_0$ (B) = 0.45 m) | V = 5 kg/h | 17.0 kg (0.266 kg/$m^2$) | 32.4 kg (0.270 kg/$m^2$) | 38.5 kg (0.267 kg/$m^2$) |
| | V = 10 kg/h | 12.1 kg (0.189 kg/$m^2$) | 22.8 kg (0.190 kg/$m^2$) | 27.4 kg (0.190 kg/$m^2$) |
| | V = 75 kg/h | 5.57 kg (0.0870 kg/$m^2$) | 10.4 kg (0.0867 kg/$m^2$) | 12.4 kg (0.0861 kg/$m^2$) |

TABLE 15

$m_{max}$ with respect to $h_0$ = 0.6 [m] or M upper limit with respect to $h_0$ (B) = 0.15[m] ($m_{max}$/A or M upper limit/A in parenthesis)

| | | FLOOR SPACE A | | |
|---|---|---|---|---|
| | | 64 $m^2$ | 120 $m^2$ | 144 $m^2$ |
| $m_{max}$ ($h_0$ = 0.6 m IN FORMULA III) | V UNRELATED | 2.73 kg (0.0427 kg/$m^2$) | 3.74 kg (0.0312 kg/$m^2$) | 4.10 kg (0.0285 kg/$m^2$) |
| M UPPER LIMIT ($h_0$ (B) = 0.15 m) | V = 5 kg/h | 4.43 kg (0.0692 kg/$m^2$) | 8.52 kg (0.0710 kg/$m^2$) | 9.97 kg (0.0692 kg/$m^2$) |
| | V = 10 kg/h | 3.50 kg (0.0547 kg/$m^2$) | 6.55 kg (0.0546 kg/$m^2$) | 7.86 kg (0.0546 kg/$m^2$) |
| | V = 75 kg/h | 1.92 kg (0.0300 kg/$m^2$) | 3.74 kg (0.0312 kg/$m^2$) | 4.18 kg (0.0290 kg/$m^2$) |

As described above, Example 4 has provided the results similar to those in Examples 1 to 3 (the results that the flammable area was not generated even in the excess of $m_{max}$, M upper limit needs to be decreased according as G is increased, and G correlates to M/A).

In the examples in which $h_0$ conforming to IEC60335-2-40 is equal to the installation height of the indoor unit (the floor height of the lower end of the indoor unit 1) in the tables 10 to 13, it is obvious that (M upper limit/A), i.e., (the maximum value of M/A) is always greater than ($m_{max}$/A). In this case, the greater the G, and the smaller the $h_0$, the smaller (the maximum value of M/A) becomes.

Then, the relationship between the maximum value of M/A [kg/$m^2$] and $h_0$[m] in the average leakage speeds V (5 kg/h, 10 kg/h, and 75 kg/h) was investigated.

The maximum values of M/A in each V and $h_0$ are plotted in the abscissa and in the ordinate respectively, thereby, the following relational expressions were obtained.

$$h_0(V=5\ [\mathrm{kg/h}])=1.69\times(M/A) \quad \text{(Formula IV)}$$

$$h_0(V=10\ [\mathrm{kg/h}])=2.38\times(M/A) \quad \text{(Formula V)}$$

$$h_0(V=75\ [\mathrm{kg/h}])=5.21\times(M/A) \quad \text{(Formula VI)}$$

The relationship among the value of V, gradient of straight lines of Formulas IV to VI (=grad [$m^3$/kg]=($h_0$·A)/M), and reciprocal of gradient of straight lines (=1/grad [kg/$m^3$]=M/($h_0$·A) is given in table 16.

TABLE 16

| AVERAGE LEAKAGE SPEED V | GRADIENT OF STRAIGHT LINE (grad) | RECIPROCAL OF GRADIENT OF STRAIGHT LINE (1/grad) |
|---|---|---|
| 5 [kg/h] | 1.69 [$m^3$/kg] | 0.591 [kg/$m^3$] |
| 10 [kg/h] | 2.38 [$m^3$/kg] | 0.421 [kg/$m^3$] |
| 75 [kg/h] | 5.21 [$m^3$/kg] | 0.192 [kg/$m^3$] |

V and (1/grad) are plotted in the abscissa and in the ordinate respectively, which well agrees with power approximation and gives the following formula.

$$(1/\text{grad})=M/(h_0 \cdot A)=1.11\times V^{-0.41}$$

$$M=1.11\times V^{-0.41}\times h_0\times A$$

Here, G is substituted for V, which gives the following formula.

$$M=1.11\times G^{-0.41}\times h_0\times A \quad \text{(Formula VII)}$$

where, M is a refrigerant amount [kg], G is an assumed maximum leak speed [kg/h], $h_0$ is an installation height [m] and A is an installation floor space [$m^2$].

The above description and $M\leq\alpha\times G^{-\beta}\times h_0\times A$ . . . (Formula III) show that a flammable area is not generated according to (Formula III) with $\alpha=1.11$ and $\beta=0.41$ in the case of R32. This has shown the effectiveness of the present invention.

To ensure higher safety with reference to the results (in tables 13 to 15) that the lower end position (substantially equal to floor height) of the capillary 53 being the floor height of the refrigerant leakage position is changed in Example 4, $h_0$ in (Formula II) may use the floor height ($h_0$ (A)) of the air outlet 4 or the air inlet 3 whichever is lower or the floor height ($h_0$ (B)) of the refrigerant pipe 15 or the refrigerant pipe fitting 16 whichever is lower instead of the value conforming to IEC60335-2-40.

Thereby, safety is further improved when the actual refrigerant leakage position (the floor height) is lower than the $h_0$ conforming to IEC60335-2-40.

However, like A=64 [$m^2$] and G=75 [kg/h] in table 15, there may be a range that substantially does not have a solution. This shows that $h_0$=0.6 [m] at $h_0$ (B)=0.15 [m] does not hold true any more at the time of a high speed leakage such as G=75 [kg/h], which does not have any influence on the effectiveness of the present invention.

As described above, safety can be ensured enough at the assumed maximum leak speed G of 5 kg/h. However, G is taken as 10 kg/h to allow the generation of the flammable area to be suppressed in almost all the refrigerant leakage accidents. Particularly, in the floor-type indoor unit, $h_0$ is made as lower as possible to further increase safety. In other words, the following further increases safety.

$M/A\leq 1.30$ [kg/$m^2$] in $h_0$=2.2 [m] or more
$M/A\leq 0.925$ [kg/$m^2$] in $h_0$=1.8 [m] or more
$M/A\leq 0.421$ [kg/$m^2$] in $h_0$=1.0 [m] or more
$M/A\leq 0.252$ [kg/$m^2$] in $h_0$=0.6 [m] or more
$M/A\leq 0.189$ [kg/$m^2$] in $h_0$=0.45 [m] or more
$M/A\leq 0.0546$ [kg/$m^2$] in $h_0$=0.15 [m] or more The above measurements and approximations include errors, so that it is obvious that each value has more or less variation. So many data do not need to be taken, but it is assumable that the more the data used for the approximation, the smaller the error.

Furthermore, in table 16, another approximation can be made. For example, the average leakage speed V [kg/h] and grad [$m^3$/kg] are plotted in the abscissa and in the ordinate respectively to perform a log approximation, giving the following formulas.

$$\text{grad}=(h_0 \cdot A)/M=1.3\times \text{Ln}(V)+0.5 \quad \text{(Formula VIII)}$$

where Ln(V) is a natural logarithm of V.

Thereby, the following formula is given, $$M=\{1/(1.3\times \text{Ln}(V)+0.5)\}\times h_0\times A \quad \text{(Formula IX)}$$

which substitutes G for V.

Thereby, the following formula is given, $$M\leq\{1/(1.3\times \text{Ln}(G)+0.5)\}\times h_0\times A \quad \text{(Formula X)}$$

which can also suppress the generation of the flammable area.

Other than the above, various approximations are can be made such as, grad=$0.9\times V^{0.41}$, or 1/grad=$-0.14\times \text{Ln}(V)+0.8$, however, it is obvious that the approximation highest in versatility and accuracy is (Formula VII).

Embodiment 2

The experiment made in Embodiment 1 was conducted by using HFO-1234yf substituted for the refrigerant gas.

As a result, the following formula was obtained.

$$2.5\times(\text{LFL})^{125}\times h_0\times A^{0.5}\leq M\leq\alpha\times G^{-\beta}\times h_0\times A$$

where, $\alpha$=0.78, and $\beta$=0.34

The lower limit is as follows, $$2.5\times(0.294\ [\text{kg/m}^3])^{1.25}\times h_0=2.5\times 0.217\times h_0=0.54\ [\text{kg}],$$

which confirmed that the advantage of the present invention could be obtained.

Embodiment 3

The experiment made in Embodiment 1 was conducted by using propane (R290: $C_3H_8$) high in flammability.

As a result, the following formula was obtained.

$$2.5\times(\text{LFL})^{1.25}\times h_0\times A^{0.5}\leq M\leq\alpha\times G^{-\beta}\times h_0\times A$$

where, $\alpha$=0.22, and $\beta$=1.0

Where, when LFL of propane is taken as 0.038 kg/$m^3$ (2.1 vol %), the lower limit is as follows, $$2.5\times(0.038\ [\text{kg/m}^3])^{1.25}\times h_0\times(A)^{0.5}=$$
$$2.5\times 0.0168\times h_0\times(A)^{0.5}=0.042\times h_0\times(A)^{0.5}.$$

On the other hand, the upper limit is as follows, $$0.22\times G^{-1}\times h_0\times A.$$

In the case of G=5 [kg/h], $$M\leq 0.22\times(5)^{-1}\times h_0\times A=0.044\times h_0\times A \text{ is given, and}$$

$M\leq 0.0264A$ holds true for $h_0$=0.6 [m], and
$M\leq 0.0968A$ holds true for $h_0$=2.2 [m].

Thus, it was found that the higher the flammability of gas (propane, for example), the smaller the upper limit of the refrigerant amount M needs to be. It was also found that the lower the flammability of gas, the greater the upper limit of the refrigerant amount M can be.

The results obtained in the Embodiments 1 to 3 are summarized in the following table.

TABLE 17

| TYPE OF REFRIGERANT | GAS DENSITY AT 25 DEGREES C. (kg/$m^3$) | LFL AT 25 DEGREES C. (kg/$m^3$) | $\alpha$ | $\beta$ |
|---|---|---|---|---|
| R32 | 2.13 | 0.306 | 1.11 | 0.41 |
| HFO-1234yf | 4.66 | 0.289 | 0.78 | 0.34 |
| $C_3H_8$ | 1.80 | 0.038 | 0.22 | 1.00 |

Where, $\alpha$ is taken as a positive constant that the refrigerant mainly correlates to LFL and $\beta$ is taken as a positive constant that the refrigerant mainly correlates to density.

However, it is clear from Table 17 that the greater the LFL, the greater the α, and the greater the gas density, the smaller the β.

These approximate equations can be substantially represented by the following.

$$\alpha=0.2\ \exp[6\times\mathrm{LFL}]$$

$$\beta=-0.5\ \mathrm{Ln}[\text{gas density}]+1$$

Thereby, α correlates to a lower flammability limit [kg/m$^3$] and β correlates to gas density at about 25 degrees C.

However, these amounts do not sometimes strictly follow because they are influenced by liquefaction temperature or saturation vapor pressure.

The formulas can be represented as follows.

$$\alpha=X\ \exp[Y\times\mathrm{LFL}]$$

$$\beta=-Z\ \mathrm{Ln}[W\times\text{density}]+1$$

where X, Y, Z, and W are positive constants determined by the type of refrigerant.

Description has been made in Embodiments 1 to 3 using R32, HFO-1234yf, and R290 as representative examples, but it is needless to say that the description also holds true for other HFC refrigerants or those mixed refrigerants.

It is also needless to say that the air-conditioning apparatus installed according to the above embodiments fills an effective refrigerant amount and does not lose safety.

The invention claimed is:

1. An air-conditioning apparatus comprising an indoor unit provided with an indoor heat exchanger and using a flammable refrigerant being higher in density than air under the atmospheric pressure, wherein a refrigerant amount M [kg] to be filled falls within the following formula:

$$0.53\times h_0\times A^{0.57}\leq M\leq\alpha\times G-\beta\times h_0\times A \quad \text{(Formula)}$$

where the indoor unit is installed at an installation height of $h_0$ [m] or more in an installation floor space A [m$^2$], LFL is a lower flammability limit of the refrigerant [kg/m$^3$], G is an assumed maximum leak speed of the refrigerant [kg/h], α is a positive constant of the refrigerant equal to 0.2 exp [6×LFL], β is a positive constant of the refrigerant equal to −0.5 Ln [gas density]+1, and the flammable refrigerant is R32.

2. The air-conditioning apparatus of claim 1, wherein, when the installation height $h_0$ is 2.2 m or more and G≥5, the refrigerant amount M has a range satisfying M≤1.3A according to the above formula.

3. The air-conditioning apparatus of claim 1, wherein when the installation height $h_0$ is 1.8 m or more and G≥5, the refrigerant amount M has a range satisfying M≤1.06A according to the above formula.

4. The air-conditioning apparatus of claim 1, wherein, when the installation height $h_0$ is 1.0 m or more and G≥5, the refrigerant amount M has a range satisfying M≤0.42A according to the above formula.

5. The air-conditioning apparatus of claim 1, wherein, when the installation height $h_0$ is 0.6 m or less and G≥5, the refrigerant amount M has a range satisfying M≤0.25A according to the above formula.

6. The air-conditioning apparatus of claim 1, wherein, α is 1.1 and β is 0.41.

7. A method of installing an air-conditioning apparatus using the air-conditioning apparatus of claim 1.

8. The air-conditioning apparatus of claim 1, further comprising:

an input unit to which M, A, LFL, $h_0$, G, α, and β are input;

a control apparatus configured to detect and monitor as to whether the formula is satisfied; and a notification unit configured to make a notification when the control apparatus detects that a threshold value set by the formula is exceeded.

* * * * *